US005290115A

United States Patent [19]

Little

[11] Patent Number: 5,290,115

[45] Date of Patent: Mar. 1, 1994

[54] CUSHIONING MEANS FOR KEYBOARD KEYS

[76] Inventor: Karen K. Little, 933 N. Marshall St. - Apt. 207, Milwaukee, Wis. 53202

[21] Appl. No.: 583,519

[22] Filed: Sep. 17, 1990

Related U.S. Application Data

[63] Continuation-in-part of Ser. No. 356,767, May 25, 1989, abandoned.

[51] Int. Cl.[5] ..... B41J 5/12

[52] U.S. Cl. ..... 400/491; 400/490; 400/493

[58] Field of Search ..... 400/491, 490, 491.1, 400/491.2, 491.3, 493; 341/20, 22, 23; 178/17 C; 84/433, 744, 745, DIG. 7

[56] References Cited

U.S. PATENT DOCUMENTS

| | | | |
|---|---|---|---|
| 832,617 | 9/1906 | Munson | 400/491 |
| 1,203,570 | 11/1916 | Beaubien | 400/491 |
| 2,030,135 | 2/1936 | Carpenter | 428/40 |
| 2,057,873 | 10/1936 | Atwood | 428/40 |
| 2,102,526 | 12/1937 | Guilfoyle | 400/491 |
| 2,181,955 | 12/1939 | Ward | 400/491 |
| 2,184,077 | 12/1939 | Hart | 428/40 |
| 2,190,210 | 2/1940 | Kaber | 428/40 |
| 2,191,704 | 3/1935 | Bennett | 428/40 |
| 2,733,804 | 2/1956 | Wesson | 400/491.1 |
| 2,844,065 | 9/1952 | Corwin | 84/433 |
| 4,042,090 | 8/1977 | Hasebe et al. | 400/490 |
| 4,657,419 | 4/1987 | Takakuwa | 400/491 |
| 4,734,679 | 3/1988 | Haskins | 341/22 |
| 4,755,072 | 7/1988 | Hoornweg | 400/490 |
| 4,806,908 | 2/1989 | Krupnik | 341/22 |

*Primary Examiner*—David A. Wiecking
*Assistant Examiner*—John S. Hilten
*Attorney, Agent, or Firm*—Ryan, Kees & Hohenfeldt

[57] ABSTRACT

A cushioning apparatus for reducing the impact felt by the fingertips of a typist using a keyboard. A conventional keyboard includes a plurality of keys, each corresponding to at least one character or number, and each having a hard keytop. According to the invention, a pad is attached or applied to each keytop, each pad being substantially softer than the associated hard keytop. Each pad has a flat top surface, with a legend thereon indicating the keytop to which it is attached. Each pad also has a flat bottom surface, with adhesive applied thereto, and a single sheet of release paper removably applied to the adhesive for all the pads, the adhesive being provided for attaching the pad to the respective keytop, or to the top of another pad, to provide additional thickness of padding.

11 Claims, 1 Drawing Sheet

CUSHIONING MEANS FOR KEYBOARD KEYS

CROSS-REFERENCE TO RELATED APPLICATION

This application is a continuation-in-part of application Ser. No. 07/356,767, filed May 25, 1989, now abandoned.

BACKGROUND OF THE INVENTION

This invention relates to cushioning apparatus, and in particular to such cushioning or shock absorbing apparatus as is used in connection with the keyboard of a computer or electronic typewriter.

With the advent of the information age, more and more people are obtaining and using computers and electronic typewriters, whether at work or at home or both. The main input device for most computers and electronic typewriters in use today is the keyboard, and so the use of keyboards has also increased.

With the increase in the use of keyboards has come an increase in injuries or pain caused by repetitive use of the fingers. This is due at least partly to the fact that, prior to electronic keyboards, keys for mechanical typewriters actuated the typing mechanism by means of springs and levers, and the final impact was that of a lever on a rubber platen. With electronic keyboards, on the other hand, the key bottoms on a hard mechanical stop, increasing the impact to the fingers caused by typing. Moreover, typists using keyboards with computers and electronic typewriters have much less worry about making mistakes because of the ease of later correction. This has the effect of permitting such typists to type faster and for longer periods, increasing the abuse to their hands.

Typists using prior art electronic keyboards have experienced radiating pain, nerve damage, bone damage and arthritis in the joints. Nerve damage is felt through increased sensitivity to heat and cold, as well as radiating pains along the sides of the fingers. Fingertips may also feel like they are burning when they touch the keyboard. Hence there appears to be need in the market for some device or apparatus for reducing the pain caused in some individuals by repetitive keyboard use.

This invention relates to improvements to the devices described above and to solutions to the problems raised or not solved thereby.

SUMMARY OF THE INVENTION

It is the experience of applicant that pain occurs in her wrists and fingers after a long day of typing, and that she is not alone in this experience. Applicant applied a number of changes to her work environment in an attempt to solve this problem, such as changing the level of the keyboard and adjusting the spring rate of the keys, all to no avail.

This invention relates to functional solutions to this problem. The invention includes cushioning means for adapting a keyboard, having a plurality of keytops, so as to cushion the impact of the fingertips of a typist on the keytops. The cushioning means includes a plurality of discrete pads, each shaped, sized and some given a legend to be applied to a predetermined key. Each pad is substantially softer than the upper surfaces of the keytops. Adhesive means are provided for holding each pad on a respective key. Release paper may be removably applied to the adhesive to cover it prior to use. By application of these pads to the keytops, the impact felt by the fingertips of a typist in using the keyboard is reduced. Further, using the cushioning apparatus according to the invention, the typist has the option to add a greater level of padding to certain keys when necessary or desired.

Other objects and advantages of the invention will become apparent hereinafter.

DESCRIPTION OF THE PREFERRED EMBODIMENT

Figure 2:
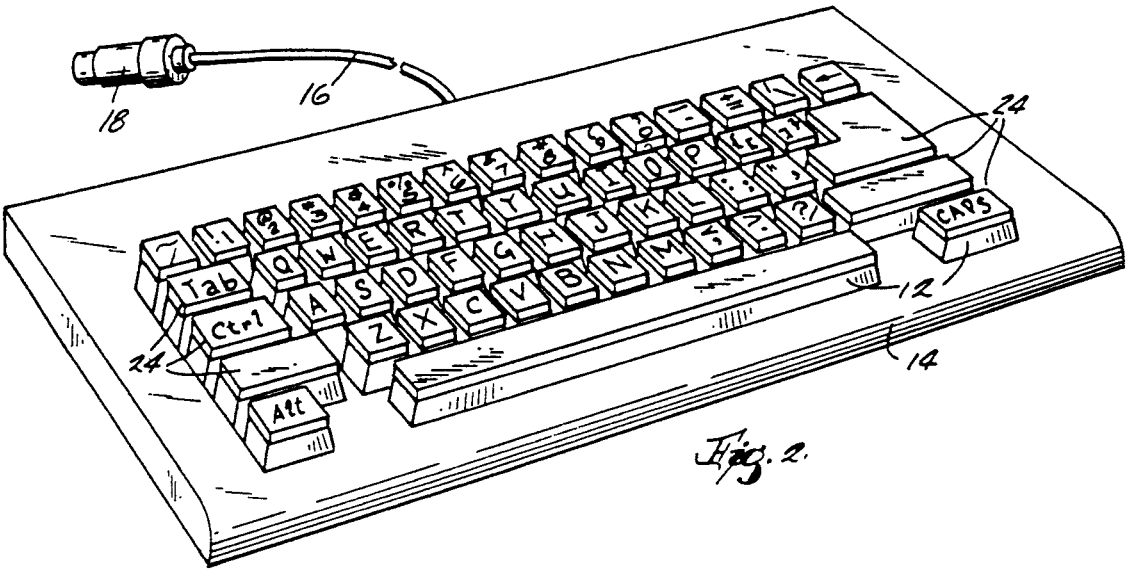
FIG. 2 is an isometric view of a keyboard having the cushioning apparatus applied thereto according to the invention.
Figure 1:
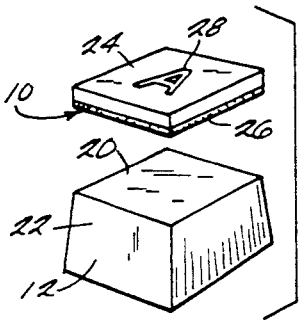
FIG. 1 is an exploded isometric view of a cushioning apparatus and keyboard key constructed according to a preferred embodiment of the invention.

Referring now to FIG. 1, there is shown an exploded view of a cushioning apparatus 10 constructed generally according to a preferred embodiment of the invention. In the embodiment there shown, a keyboard key 12 of generally conventional construction is supplied. As is well know, referring to FIG. 2, keyboards 14 in general include a plurality of such keys 12. The user of the keyboard 14 presses the keys 12 in order to communicate with some output device such as a computer (not shown), by means of a cord 16 and plug 18. Alternatively, in the case where the keyboard 14 is part of an electronic typewriter (not shown), the output device referred to is the typewriter printing means or print element (not shown).

In either case, as shown best at FIG. 1, generally each key 12 will have a generally flat or slightly concave upper surface or keytop 20, and sides 22 which angle generally downward and which may be slightly outwardly convex. Most often, because of the internal structure of the keyboard 14, generally the key 12 will snap down when pressed, and will snap upward when released.

The present invention is directed to applying the cushioning apparatus 10 to the keytops 20 of the keys 12, since applicant has found that pain occurs in her fingers after a long typing day, and she attributes the cause of this pain to the surface of the keytops 20, and particularly the hardness thereof. Alternatively she attributes the pain to the fact that the bottom of the stroke of the press of any key 12 is a hard stop, as well as the fact that each key snaps up when released besides snapping down when pressed.

A keyboard 14 is typically manufactured with long service in mind, rather than reducing impact on the typist's fingertips.

In order to solve this problem, according to the invention, the apparatus 10 includes pads 24 are applied to the keytops 20, by means of any suitable adhesive 26. Pads 24 are constructed of any suitable resilient material that is substantially softer than the keytops 20 themselves, and yet sufficiently strong to stand up to extended use by a typist. A further preference is that the material present a relatively smooth upper surface, so that friction on the typist's fingertips is not increased over use of the keytops 20 without the pads 24. The material that is most preferred because applicant has found it to work well is a closed cell or mini-cell foam of about one-eighth to one-quarter inch in thickness, depending upon the degree of cushioning desired, and of a hardness substantially softer than the normal keytops. Certainly any hard material such as metal or plastic would be unsuitable and defeat the purpose of the invention.

Figure 3:
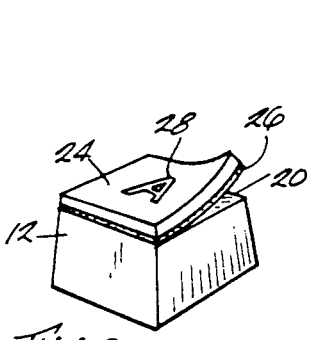
FIG. 3 is an isometric view of the apparatus showing one of the pads being peeled off a keyboard key.
Figure 4:
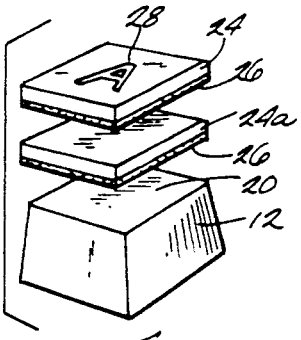
FIG. 4 is a side view of a keyboard key having duplicate cushioning devices applied thereto.

As indicated above, to this material is applied an adhesive 26, to be used to attach the respective pad 24 to each of the keytops 20. This adhesive 26 is of a removable type, so that the pads 24 may be easily peeled off, as shown in FIG. 3, and replaced if they do begin to show wear, or if they begin to lose their resiliency. As shown in FIG. 4, one or more additional layers 24*a* of pads may be applied to individual keytops 20, in addition to the pad 24 provided for that particular key 12, according to the typist's or user's individual need or desire for cushioning, to further increase the padding effect. In this way the cushioning means of the invention is provided in a way that is renewable at the option of the user. In addition, the user also has the option to determine the amount of padding he or she personally requires on any particular key. The prior art simply does not provide these capabilities.

As shown the drawing figures, since it is assumed that the pads 24 are opaque, it is necessary to apply a legend 28 to each such pad, so that once the pads are applied to the keytops 20, the keys 12 can still be read.

Figure 5:
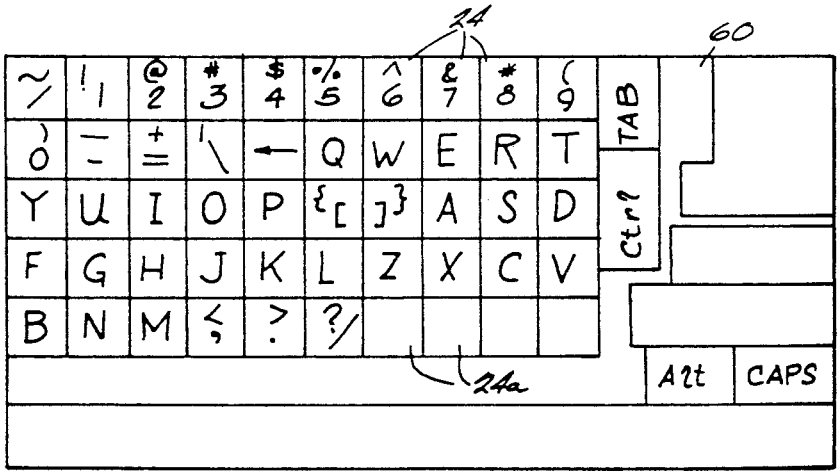
FIG. 5 is a front view of a number of pads according to the invention, arranged efficiently on a single sheet of release paper.

Use of the pads 24 will be facilitated by distribution of the pads already having the adhesive 26 applied to the backside thereof, and this distribution is not generally practical without the application of a release sheet 30. FIG. 5 shows one possible layout of the pads 24 on a release sheet 30, so as to maximize the efficient use of space. It is desirable for efficiencies of manufacture and shipping that all the pads 24 and 24*a* be cut from a single sheet of padding material, and that all the pads be shipped on a single sheet 30 of release paper.

While the apparatus hereinbefore described is effectively adapted to fulfill the aforesaid objects, it is to be understood that the invention is not intended to be limited to the specific preferred embodiment of keyboard apparatus set forth above. Rather, it is to be taken as including all reasonable equivalents within the scope of the following claims.

I claim:

1. Cushioning means for adapting a keyboard, having a plurality of keytops, so as to cushion the impact of the fingertips of a typist on said keytops, said cushioning means comprising:

a plurality of separate pads, each shaped and sized to fit onto a predetermined key, each of said pads being substantially softer than said keytops, each of said pads being substantially flat, of substantially homogeneous material and of a substantially uniform thickness after installation, and having substantially flat top and bottom surfaces after installation, said flat top surface of each said pad being substantially exposed for direct contact with the fingertips of the typist;

adhesive means for holding each said pad on a respective keytop surface, said adhesive means comprising adhesive material applied to each said flat bottom surface for attaching said pad to said predetermined key;

designation means for designating the key to which each pad is to be and has been applied and a second pad having an identical shape and size as said pads and installable on top of each of one or more of said pads so as to provide extra cushioning to chosen keys.

2. Cushioning means as recited in claim 1 wherein said pads are about ⅛ inch thick.

3. Cushioning means for adapting a keyboard, having a plurality of keytops, so as to cushion the impact of the fingertips of a typist on said keytops, said cushioning means comprising:

a plurality of separate pads, each shaped and sized to fit onto a predetermined key, each of said pads being substantially softer than said keytops, each of said pads being substantially flat, of substantially homogeneous material and of a substantially uniform thickness after installation, and having substantially flat top and bottom surfaces after installation, said flat top surface of each said pad being substantially exposed for direct contact by the fingertips of the typist;

adhesive means for holding each said pad on a respective keytop surface, said adhesive means comprising adhesive material applied to each said flat bottom surface for attaching said pad to said predetermiend key, and for rendering said pad to be peelably removable from said keytop surface; and a second pad having an identical shape and size as said pads and also substantially softer than said keytops, installable on top of each of one or more of said pads so as to provide extra cushioning to keys chosen by said typist, said second pad also being of substantially homogeneous material and having a top surface being substantially exposed for direct contact by the fingertips of the typist on those keys where applied.

4. In combination with a keyboard, such as for an electronic typewriter or computer, said keyboard having a number of keys, each of said keys having a hard keytop surface, means for reducing the impact felt by the fingertips of a typist using the keyboard, comprising:

a discrete pad provided for each respective keytop surface, each said pad being substantially flat, of substantially homogeneous material and of a substantially uniform thickness after installation, having an outline which exactly corresponds to said respective keytop surface, and having flat top and bottom surfaces, and having a hardness substantially less than that of said keytop surface, said pad top surface being substantially exposed for direct contact by the fingertips of the typist;

attachment means for attaching each of said pad means to each of said keytop surfaces, said attachment means comprising adhesive applied to each said flat bottom surface for attaching said pad means to said respective keytop surface; and a second pad having an identical shape and size as said pads and also having a hardness substantially less than that of said keytop surface, installable on top of each of one or more of said discrete pads so as to provide extra cushioning to keys chosen by said typist, said second pad also being of substantially homogeneous material and having a top surface being substantially exposed for direct contact by the fingertips of the typist on those keys where applied.

5. The combination set forth in claim 4 further comprising matching means applied to the top of each of said pad means for indicating the keytop to which said pad means is attached.

6. The combination set forth in claim 4 further comprising release paper removably applied to said adhesive, which release paper is removed prior to application of the pad to the respective keytop.

7. The combination set forth in claim 4 wherein said pad means are about ⅛ inch thick.

8. A keyboard apparatus, comprising:

a plurality of keys, each corresponding to at least one character or number, and each having a keytop surface;

means for said keys communicating with an output device;

a pad supplied for each respective key, each said pad being substantially softer than said keytop surface, each pad being substantially flat, of substantially homogeneous material and of a substantially uniform thickness after installation, having an outline which closely corresponds to said respective keytop, and having substantially flat top and bottom surfaces after installation, said flat top surface of each said pad being substantially exposed for direct contact by the fingertips of the typist;

adhesive applied to each said flat bottom surface for attaching said pad to said respective keytop surface; and a second pad having an identical shape and size as said pad and mountable on top of each of at least one of said pads after application to said keytop surface.

9. A keyboard apparatus as recited in claim 8 wherein said pads are about ⅛ inch thick.

10. A keyboard apparatus as recited in claim 8 wherein each said pad has a top surface, with a legend thereon indicating the keytop to which it is attached.

11. A keyboard apparatus as recited in claim 10 wherein each said pad has a bottom surface, with adhesive applied thereto, and a single sheet of release paper removably applied to said adhesive for all of said pads, said adhesive attaching said pad to the respective keytop when applied thereto.

* * * * *